US005360120A

United States Patent [19]

Stanton, Jr.

[11] Patent Number: 5,360,120

[45] Date of Patent: Nov. 1, 1994

[54] RACK SYSTEM

[75] Inventor: Gerald J. Stanton, Jr., Clive, Iowa

[73] Assignee: Mighty Metal, Inc., Des Moines, Iowa

[21] Appl. No.: 73,782

[22] Filed: Jun. 8, 1993

[51] Int. Cl.[5] ..... A47F 7/00

[52] U.S. Cl. ..... 211/60.1; 211/59.4; 211/194

[58] Field of Search ..... 211/41, 45, 60.1, 44, 211/49.1, 162, 189, 194, 59.4

[56] References Cited

U.S. PATENT DOCUMENTS

| | | | |
|---|---|---|---|
| 3,138,261 | 6/1964 | Witteborg | 211/41 |
| 3,732,633 | 5/1973 | Margolis et al. | 211/162 |
| 3,945,497 | 3/1976 | Greenberg | 211/49.1 X |
| 4,175,807 | 11/1979 | Kranich et al. | 211/194 X |
| 4,423,913 | 1/1984 | Lee | 211/194 X |
| 4,815,611 | 3/1989 | Gurzynski et al. | 211/41 X |
| 4,909,396 | 3/1990 | Younger | 211/59.4 X |

OTHER PUBLICATIONS

Chicago Steel Center Brochure.

*Primary Examiner*—Robert W. Gibson, Jr.

*Attorney, Agent, or Firm*—Zarley, McKee, Thomte, Voorhees, Sease

[57] ABSTRACT

A rack system is provided for storing a plurality of elongated pieces, such as bar stock, rods, shafts, and angle iron. The rack includes a frame with a front, a back, and opposite ends. A plurality of compartments extend horizontally and diagonally within the frame. Each compartment is designed to store one or more identical pieces in a horizontal orientation such that the pieces are horizontally slideable from their respective compartments into an area forward of the front of the frame. The diagonal orientation of the compartments with respect to the frame allows a piece having a length greater than the width or depth of the frame to be stored in the compartments. A plurality of diagonally oriented walls may also be provided within the frame to define enlarged slots for receiving sheet metal and the like. A triangular-shaped storage area is provided behind the columns of compartments.

11 Claims, 2 Drawing Sheets

RACK SYSTEM

BACKGROUND OF THE INVENTION

In retail establishments, conventional storage and display of elongated pieces of material such as bar stock, angle iron, rods and threaded shafts is a vertical orientation of the material. Typically, the shortest material is stacked in front, with progressively longer pieces of material being stacked behind the shorter pieces in the vertical storage rack. With such vertical storage, considerable overhead space is required to remove the pieces from the rack. Also, most vertical storage racks do not segregate the pieces according to individual dimensions.

Accordingly, a primary objective of the present invention is the provision of an improved rack system for storing elongated pieces of material. Another objective of the present invention is the provision of an improved rack system having a plurality of horizontally disposed storage compartments.

A further objective of the present invention is the provision of a storage rack system having horizontally disposed compartments extending diagonally within a frame for maximum space utilization.

A further objective of the present invention is the provision of an improved rack system which provides for quick and easy identification and inventory of pieces stored therein.

Still another objective of the present invention is the provision of an improved rack system for storing elongated barstock, rods, shafts, angle iron and the like which is economical to manufacture and durable in use.

These and other objectives of the invention will become apparent from the following description of the invention.

SUMMARY OF THE INVENTION

The rack system of the present invention comprises a frame having a plurality of horizontally disposed compartments therein. Each compartment is adapted to receive one or more elongated pieces of material, such as bar stock, angle iron, rods and shafts. The pieces within each particular compartment are identical.

The compartments are formed by a plurality of elongated tubes which extend diagonally within a frame. More particularly, the tubes are preferably square and adjacent tubes are welded to one another so as to form a grid or honeycomb of storage compartments. The tubes extend diagonally from the front of the frame and rearward towards one end of the frame. The longest tubes extend substantially from one front corner to the opposite rear corner of the frame. Each forward successive row of tubes is shorter than the preceding row such that the forward most edge of the tubes are in a common plane near the front of the framework. Each tube includes an exposed side wall portion which allows a label to be applied thereto for identifying the pieces of material contained within the respective tube or compartment.

A plurality of walls may also be diagonally mounted within the frame work so as to receive sheets of material therebetween. A substantially triangular-shaped storage compartment is provided in the rearward portion of the frame behind the storage tubes. A door may be provided on one end of the frame for closing the enlarged storage area.

DESCRIPTION OF THE PREFERRED EMBODIMENT

Figure 1:
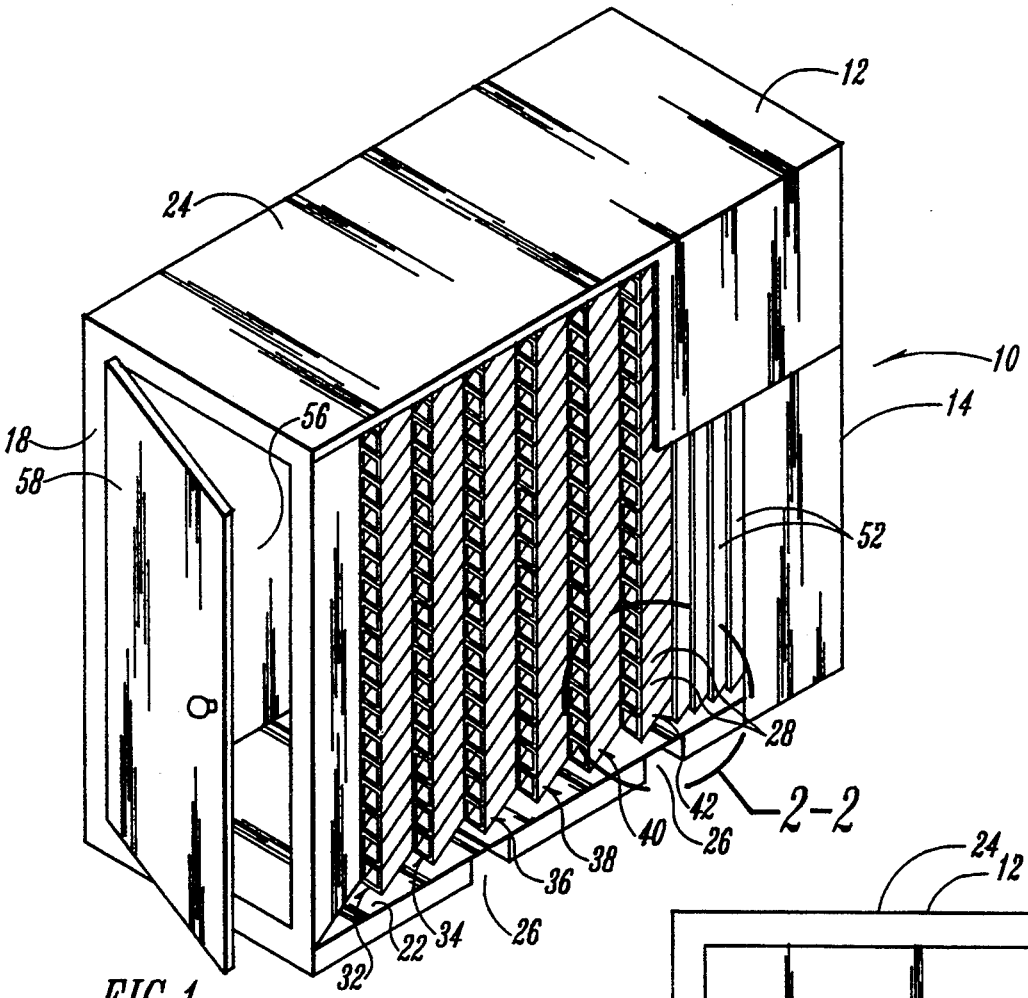
FIG. 1 is a perspective view of the rack system of the present invention.

The rack System of the present invention is generally designated in the drawings by the reference numeral 10. The rack includes a frame 12 having a front 14, a back 16, opposite ends 18 and 20, a bottom 22, and a top 24. The bottom 22 may include openings 26 therein for receipt of the forks of a fork lift truck so that the rack 10 can be moved. Mounted within the frame 12 are a plurality of tubes 28 each of which define a storage compartment 30 therein for holding an elongated piece of material, such as bar stock, rods, shafts, and angle irons. One or more identical pieces may be housed within each compartment 30. Different compartments may store different pieces. Preferably, tubes 28 are square, as shown in the drawings, though other shapes may be utilized to obtain different shaped compartments.

More particularly, the first set of tubes are welded or otherwise secured one on top of the other so as to define a first column 32 of compartments, as seen in FIG. 1. A second set of tubes are welded or secured on top of one another so as to define a second column 34 of compartments. Similar columns 36, 38, 40 and 42 are formed by additional sets of tubes stacked one on top of another. The tubes used in each successive column 32–42 are shorter than the tubes used in the preceding column, such that the length of the compartments 30 in each respective column are progressively shorter from the first column 32 to the last column 42, as seen in FIG. 5.

Figure 5:
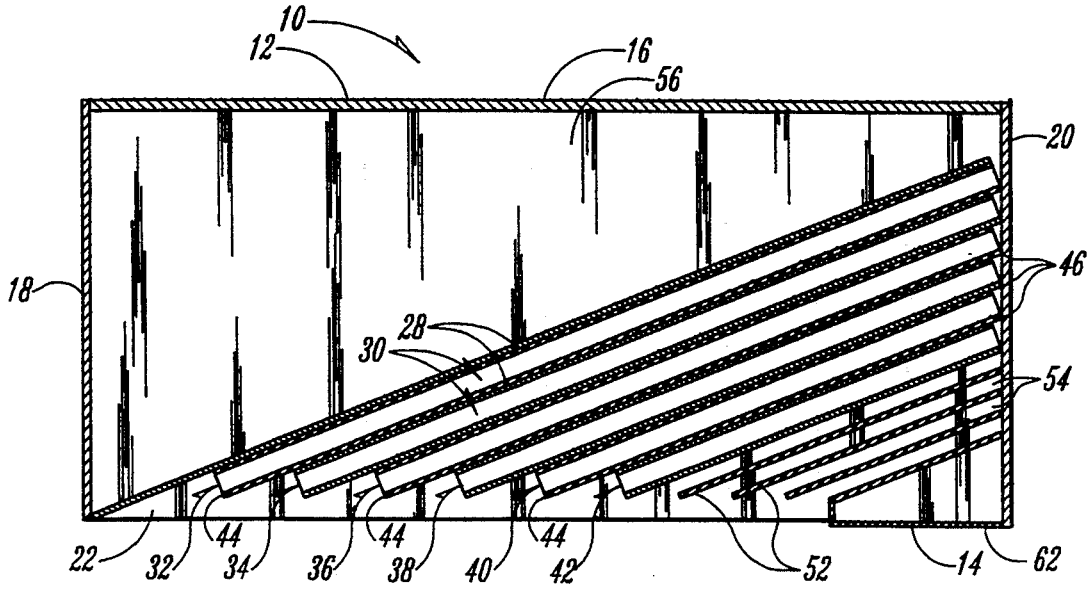
FIG. 5 is a sectional view taken along lines 5—5 of FIG. 4.

The tubes 28 are horizontally disposed, and mounted within the frame 12 so as to extend diagonally from the front 14 of the frame toward the back 16 of the frame, as seen in FIG. 5. Thus, the first column 32 of tubes extends substantially from one front corner of the frame 12 to the opposite rear corner thereof. Each column 32–42 is parallel to one another. The leading edge 44 of each set of tubes lie in a common plain, as best seen in FIG. 5. Similarly, the trailing edge 46 of each tube abuts the end 20 of the frame 12.

Figure 4:
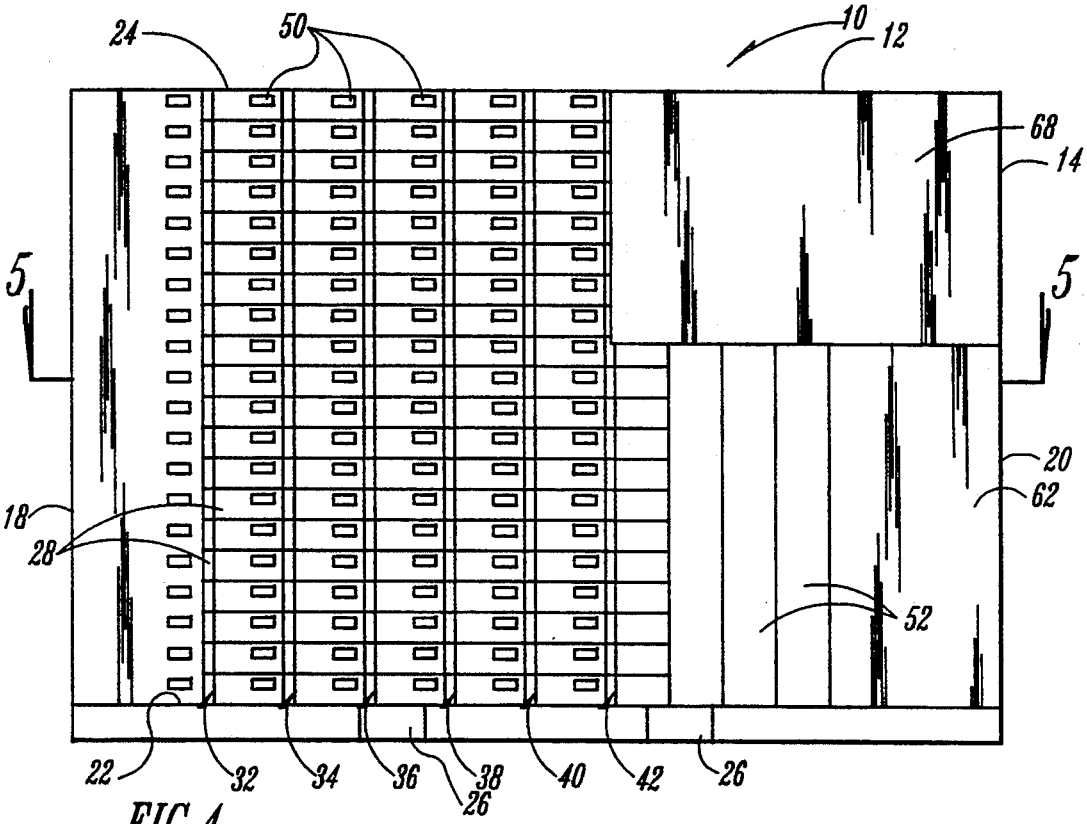
FIG. 4 is a front elevational view of the rack system shown in FIG. 1.

The forward end of each tube 28 has a visible surface 48 for receiving a label which identifies the particular piece or pieces of material contained within the respective compartment 30. Such labels are shown in FIG. 4. The labels contain information such as the dimension of the respective piece of material contained within the respective compartment. Thus, a consumer can walk up to the rack, and knowing what size piece is desired, quickly and easily locate that piece within the rack and remove the desired piece or pieces from their compartments. The label 50 may also include a conventional bar code so that the supply of pieces in the rack 10 can be quickly and easily inventoried using conventional bar code scanning equipment.

The rack 10 may also include a plurality of spaced apart vertical walls 52 mounted therein in a diagonal fashion so as to be parallel to the sets of tubes 28. The walls 52 define additional storage slots 54 for receipt of sheet material, which stands upright within the respective slots 54.

The diagonal orientation of the tubes 28 within the frame 12 define an enlarged storage area 56 behind the tubes, as best seen in FIG. 5. Storage area 56 is substantially triangular in shape. A door 58 may be provided on the end 18 of the rack 10 so as to close the storage area 56, if desired. Also, horizontal shelving (not shown) may be provided within storage area 56.

Front panels 60 and 62 may be provided as a display area, for example to show a manufacture's name or advertising.

Figure 2:
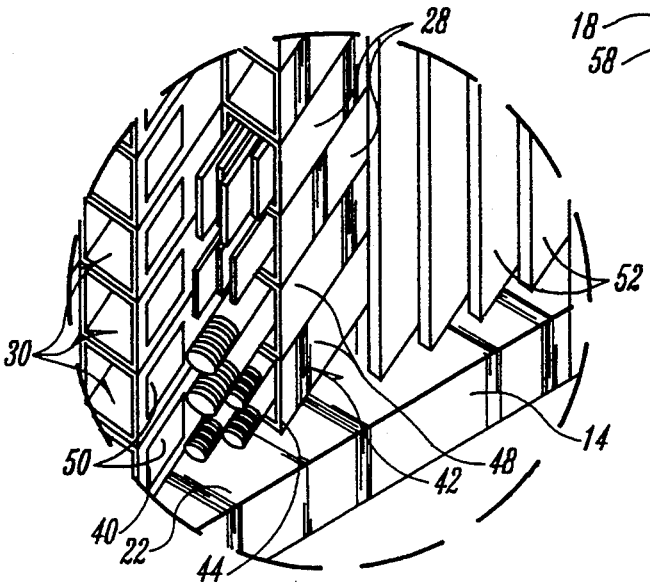
FIG. 2 is an enlarged view taken along lines 2—2 of FIG. 1 and including pieces of material within respective compartments.
Figure 3:
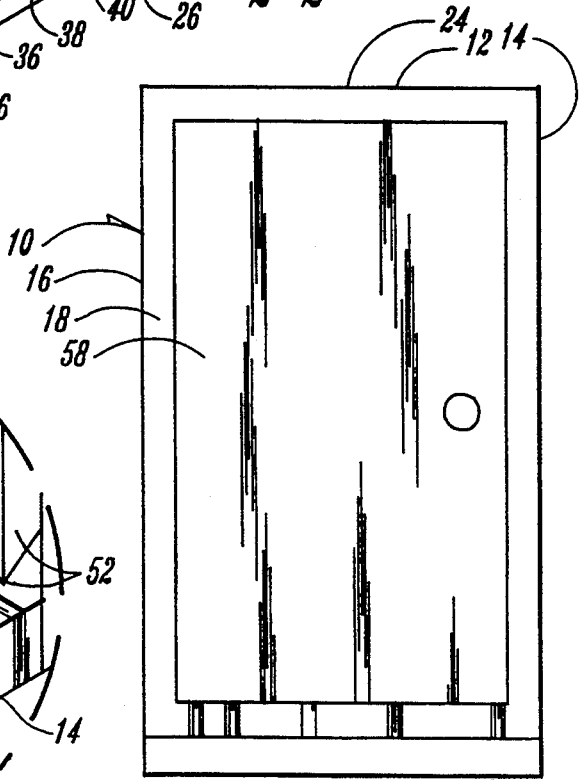
FIG. 3 is an end view of the rack system.

The rack 10 is ideally situated for warehouse type facilities which utilize pallet rack systems. In such a facility, the preferred dimensions of the rack 10 of the present invention is 99 inches wide and 36 inches deep. Accordingly, the longest diagonal is approximately 8 feet long. Preferably, the first column 32 of tubes accommodates pieces up to 8 feet long; columns 34 and 36 accommodate pieces up to 6 feet long; columns 38 and 40 accommodate pieces up to 4 feet long, and column 42 accommodates pieces up to 3 feet long. As seen in FIG. 2, the pieces stick out of the tubes several inches. If desired, an identifying label can also be applied to each piece so that the piece can be placed in the proper compartment simply by matching the label on the piece with the label 50 on the respective tubes. A stop member (not shown) may be secured in the end of each tube to prevent pieces from being slammed into the end wall 20 of the rack 10. Preferably, the tubes 28 are three inches square, and the columns 32–42 may be up to 20 tubes high. Thus, a honeycomb grid 20×6 is provided for a total of 120 individual storage compartments 30.

In loading and unloading pieces from the tubes, the aisle space in front of the rack 10 is utilized. Due to the angle of the tubes with respect to the front of the rack, conventional aisle space is sufficient for loading and unloading of pieces into the compartments.

It is understood that the above described embodiment can be varied without departing from the scope of present invention. For example, the precise diagonal orientation of the tubes with respect to the frame may be altered, if desired. Also, the cross sectional area and length of the compartments can be designed for the particular material being stored therein.

From the foregoing, it can be seen that the present invention accomplishes at least all of the stated objectives.

What is claimed is:

1. A rack system for storing a plurality of pieces comprising:

a frame having a front, a back, and opposite ends;

a plurality of compartments extending horizontally and diagonally within the frame, each compartment being adapted to store a piece in a horizontal orientation and such that the piece is horizontally slidable from the compartment into an area forward of the front of the frame for removal from the compartment, and whereby a piece having a length greater than the width or depth of the frame is storable in one of the compartments; and each compartment being formed by a tube having a first end positioned adjacent the front of the frame, the tube extending diagonally toward the back of the frame.

2. The rack system of claim 1 wherein adjacent tubes are secured to one another to form a grid of compartments.

3. The rack system of claim 1 wherein the tubes are successively longer progressing from one end of the frame toward the other end.

4. The rack system of claim 1 further including a plurality of upstanding walls each having a first end positioned adjacent the front of the frame and each wall extending diagonally rearward to define vertically extending storage slots.

5. The rack system of claim 1 further comprising a substantially triangular-shaped storage area within the frame behind the compartments.

6. The rack system of claim 1 wherein each compartment includes a surface visible from a position in front of the frame and adapted to receive a label for identifying the piece contained within the respective compartment.

7. A rack system for horizontal storing of elongated pieces of material such as shafts, rods, and bars, the rack system comprising:

a frame having a bottom wall, an open front, a back and opposite ends defining four corners of the frame;

a first set of tubes stacked one above the other to define a first vertically extending column of horizontal compartments and extending diagonally within the frame substantially from a front corner of the frame to the opposite rear corner of the frame;

a second set of tubes stacked one above the other to define a second vertically extending column of horizontal compartments, the second set of tubes being shorter than the first set of tubes and being positioned diagonally within the frame forwardly adjacent and parallel to the first set of tubes.

8. The rack system of claim 7 further comprising a plurality of additional sets of tubes stacked one above the other to define additional vertically extending columns of horizontal compartments extending diagonally within the frame, each set of tubes being shorter than the rearwardly adjacent set of tubes.

9. The rack system of claim 7 further comprising a storage area within the frame rearwardly of the first set of tubes.

10. The rack system of claim 7 wherein one end of each tube defines a label area for receiving an identifying label for the material stored in the tube.

11. The rack system of claim 7 further including a plurality of upstanding walls each having a first end positioned adjacent the front of the frame and each wall extending diagonally rearward to define vertically extending storage slots.

* * * * *